United States Patent [19]

Rouvet

[11] Patent Number: 4,723,909

[45] Date of Patent: Feb. 9, 1988

[54] WALKING BEAM OVEN FOR ADVANCING PRODUCTS AT DIFFERENT SPEEDS IN DIFFERENT SECTIONS OF THE OVEN

[75] Inventor: Claude Rouvet, Bourg-la-Reine, France

[73] Assignee: Stein Heurtey, Ris Orangis, France

[21] Appl. No.: 44,035

[22] PCT Filed: Jul. 24, 1986

[86] PCT No.: PCT/FR86/00264

§ 371 Date: Mar. 20, 1987

§ 102(e) Date: Mar. 20, 1987

[87] PCT Pub. No.: WO87/00612

PCT Pub. Date: Jan. 29, 1987

[30] Foreign Application Priority Data

Jul. 24, 1985 [FR] France ..... 85 11569

[51] Int. Cl.[4] ..... F27B 9/14

[52] U.S. Cl. ..... 432/122; 432/124; 432/239; 198/774

[58] Field of Search ..... 432/121–124, 432/239, 242; 198/774, 614

[56] References Cited

U.S. PATENT DOCUMENTS

| | | | |
|---|---|---|---|
| 3,721,519 | 3/1973 | Venetta | 432/239 |
| 3,749,550 | 7/1973 | Sugdam | 432/122 |
| 4,102,449 | 7/1978 | Shufran | 432/122 |
| 4,403,954 | 9/1983 | Kokeguchi et al. | 432/124 |
| 4,492,565 | 1/1985 | Feroldi | 432/122 |
| 4,505,670 | 3/1985 | Silverstrini et al. | 432/124 |
| 4,624,637 | 11/1986 | Genesio et al. | 432/124 |
| 4,669,939 | 6/1987 | Harada et al. | 432/122 |

FOREIGN PATENT DOCUMENTS

| | | |
|---|---|---|
| 1324683 | 3/1963 | France . |
| 2443038 | 6/1980 | France . |

OTHER PUBLICATIONS

Patents Abstracts of Japan, vol. 9, No. 41, (C-267) (1764), 21 Feb. 1985, & JP, A, 59185722, (Sumitomo Kinkozu K.K.) 22 Oct. 1984.

*Primary Examiner*—Henry C. Yuen

*Attorney, Agent, or Firm*—Karl F. Ross; Herbert Dubno

[57] ABSTRACT

At least two successive assemblies are formed by respective walking beams and actuatable independently of one another to advance articles through an oven, with a respective hydraulic jack connected to each of the assemblies for horizontally displacing each assembly. A respective pump is connected to each of the jacks in a respective circuit having two sides, with a respective nonreturn valve provided on one of the sides of each of the circuits between each jack and the respective pump. A pair of distributors are provided in the other side of one of the circuits between one of the jacks and the respective pump, with a respective distributor provided in each of the sides of the other circuit between another of the jacks and the respective pump, and hydraulic lines connecting the distributors of the circuits. A retractable stop is provided on one of the assemblies and is selectively engageable with the other assembly, the distributors being controllable to define a first mode of operation wherein the circuits are disconnected from one another and each of the pumps drives the respective jack and the stop is retracted so that the assemblies operate independently to advance the articles, and a second mode of operation wherein the circuits are coupled through the distributors and the jacks are connected in series to only one of the pumps through the distributors and the nonreturn valves, so that with the stop engaged with the other assembly, the assemblies push one another and are thereby synchronized for joint advance of the articles.

1 Claim, 2 Drawing Figures

WALKING BEAM OVEN FOR ADVANCING PRODUCTS AT DIFFERENT SPEEDS IN DIFFERENT SECTIONS OF THE OVEN

CROSS-REFERENCE TO RELATED APPLICATION

This is a National Phase application of PCT/FR86/00264 filed July 24, 1986 and based upon French national application No. 85 11 569 filed July 24, 1985.

FIELD OF THE INVENTION

The present invention relates to ovens with walking beams in which the walking beams form at least two successive assemblies mechanically independent of each other and each being movable by means of a hydraulic jack connected to one or more supply pumps. These ovens enable products to be heated to be advanced at different speeds in the two regions of the oven corresponding to the two assemblies, which is advantageous for example when the oven is loaded partially with hot products coming from continuous casting.

BACKGROUND OF THE INVENTION

When the oven is used in a way in which the two assemblies of beams are to move articles at the same speed, it is difficult to ensure perfect synchronization between the two assemblies, because of mechanical, electronic or hydraulic imperfections, leaks in the jacks for example. This lack of synchronization results in subjecting the supports to very high forces and to displace the products during heating, which causes difficulties during removal from the oven and may even cause overlapping of these products.

To overcome this drawback it has been proposed to provide, on the one hand, means for coupling the two beam assemblies together and, on the other hand, logic control means for providing synchronized operation of the jacks. But the ovens thus constructed are complicated.

OBJECT OF THE INVENTION

The present invention has as an object an oven with mobile beams of the above mentioned type but in which the synchronized movement of the two assemblies of beams is obtained by simple means.

SUMMARY OF THE INVENTION

The oven with walking beams of the invention is characterized in that one of the assemblies of beams comprises a retractable stop able to come into contact with the other assembly so that each of these assemblies may push the other, and in that the supply means for the jacks comprise distributers enabling a circuit to be set up comprising in series one of the supply pumps, the control jack for one of the assemblies, the control jack of the other assembly and a nonreturn valve.

When the distributors are disposed so as to form the above circuit and when the stop has been brought to its active position, the liquid delivered by the pump actuates the jack of the first assembly, which pushes back the second assembly through the medium of the stop. The nonreturn valve generates a counter pressure which brakes the movement of the second assembly so that the stop carried by one of the assemblies remains in contact with the other assembly.

The oven may comprise more than two beam assemblies, in which case each beam assembly except one has a retractable stop which may come into contact with one of the adjacent beam assemblies and the distributors allow a circuit to be formed in comprising series the assembly of the control jacks.

BRIEF DESCRIPTION OF THE DRAWING

One embodiment of an oven with walking beams will be described hereafter by way of non limitative example, with reference to the accompanying drawings in which.

SPECIFIC DESCRIPTION

Figure 1:
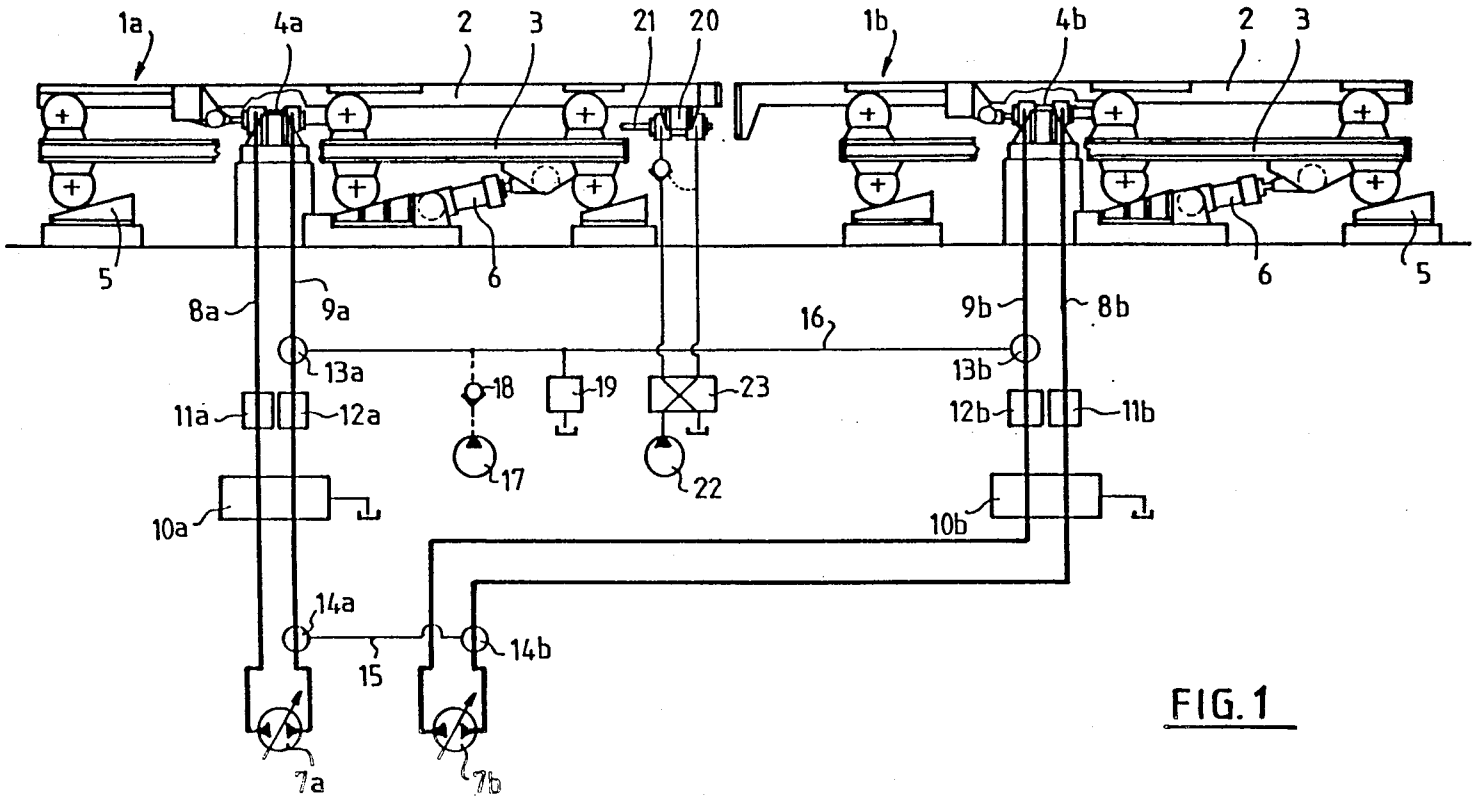
FIG. 1 is a diagrammatic view showing the oven when the two beam assemblies move independently according to the invention.

Such as is shown in the drawings, the walking beam oven of the invention includes a frame 1*a* for unloading the oven and a frame 1*b* for loading the oven. Each of these frames comprises beams 2 which are movable horizontally on a bed 3 and may be moved on this bed by a jack 4*a* or 4*b*. Bed 3 may itself be moved both vertically and horizontally on fixed ramps 5 by means of jacks 6.

Jack 4*a* is connected to a reversable pump 7*a* by means of pipes 8*a* and 9*a* in which an exchange block 10*a* is inserted; furthermore, a valve 11*a* is inserted in pipe 8*a* whereas a valve 12*a* and two distributors 13*a* and 14*a* are inserted in pipe 9*a*, the valve 12*a* being disposed between the two distributors 13*a* and 14*a*. Similarly, jack 4*b* is connected to a pump 7*b* by two pipes 8*b* and 9*b* in which an exchange block 10*b* is inserted. A valve 11*b* and a distributor 14*b* are inserted in pipe 8*b* whereas a valve 12*b* and a distributor 13*b* are inserted in pipe 9*b*.

The distributors 13*a*, 14*a*, 13*b* and 14*b* may occupy positions in which each of the pumps 7*a* and 7*b* is connected respectively to the jack 4*a* or 4*b* (FIG. 1). A pipe 15 connects the distributors 14*a* and 15*b* together and these distributors may occupy positions in which pump 7*a* is isolated from pipe 9*a* and is placed in communication with pipe 8*b* through pipe 15, this pipe 8*b* being isolated from pump 7*b*, as shown in heavy lines in FIG. 2. A pipe 16 connects the distributors 13*a* and 13*b* together and these distributors may occupy positions in which the ends of pipes 9*a* and 9*b* connected to jacks 4*a* and 4*b* are placed in communication with each other through pipe 16, while being isolated respectively from pump 7*a* and from pump 7*b*. This pipe 16 is connected to a leak compensation circuit including a pump 17, a check valve 18 and a valve 19.

On the oven unloading frame 1*a* is fixed a double acting jack 20 which actuates a retractable stop which may come into abutment against the oven loading frame 1*b*. This jack 20 is connected to a pump 22 through a distributor 23.

In FIG. 1, the distributors 13*a*, 14*a*, 13*b* and 14*b* are in their positions in which jacks 4*a* and 4*b* are connected respectively to pumps 7*a* and 7*b*, and the piston rod 21 forming the stop is moved away from frame 1*b*. Thus, the two oven unloading and loading frames 1*a* and 1*b* move independently of each other.

Figure 2:
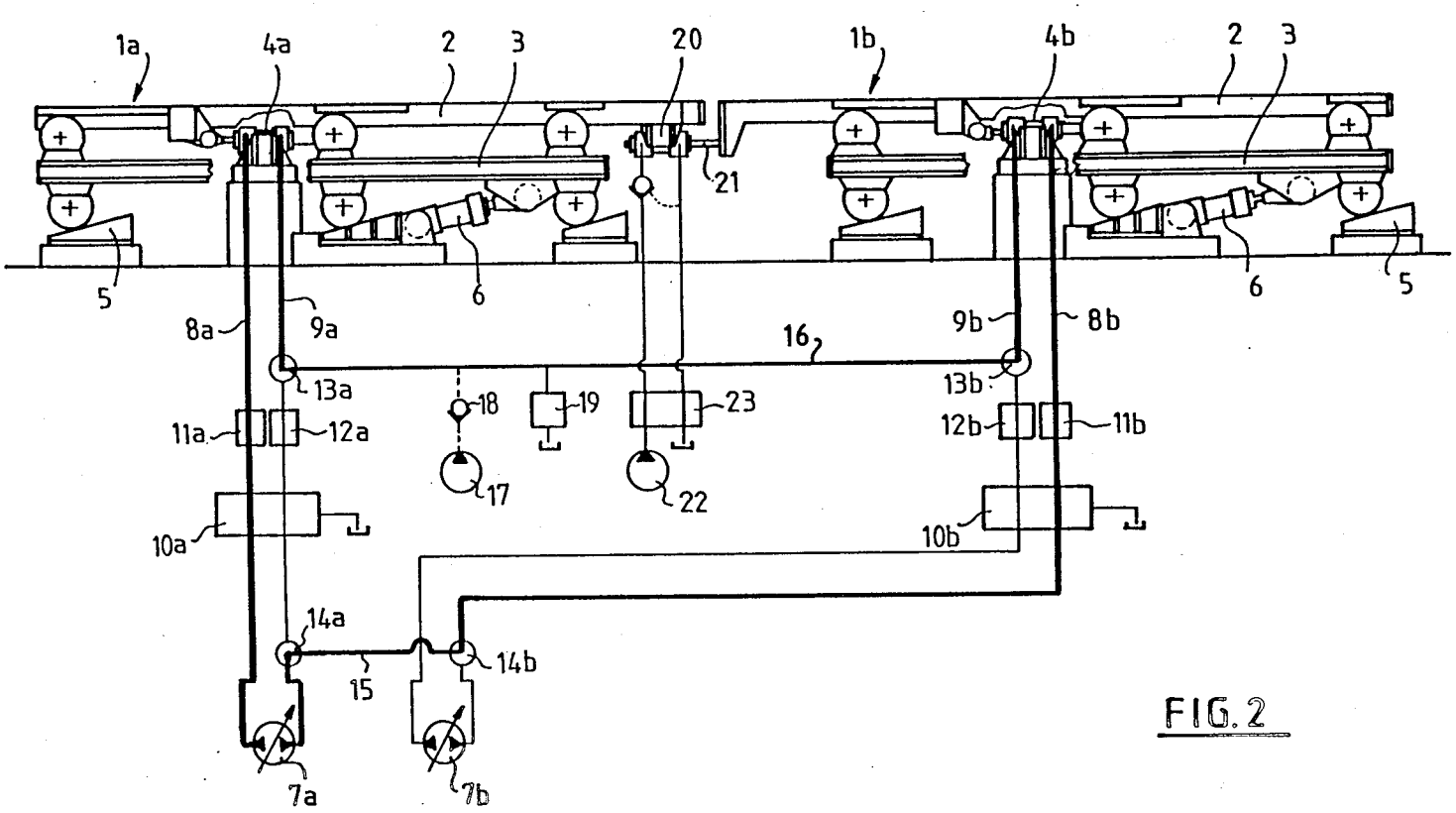
FIG. 2 is a view similar to FIG. 1, showing the oven when the two assemblies move in synchronism.

In FIG. 2, the distributors 13*a*, 13*b*, 14*a*, 14*b* are in their positions in which one of the sides of the jack 4*a* is connected to the opposite side of jack 4*b* through pipe 16, pump 7*a* being connected to the other two sides of these jacks 4*a* and 4*b*. The distributor 23 has been actuated so that the rod 21 of jack 20 is in contact against the oven loading frame 1*b*.

Under these conditions, the two frames 1*a* and 1*b* move strictly in synchronism. For advancing them, pump 7*a* delivers to jack 4*b* the oil which flows freely through the distributors 14*a* and 14*b*, the exchange block 10*b*, and valve 11*b*. Frame 1*b* pushes frame 1*a* back through the median of the abutting rod 21 and jack 20. The oil of jack 4*a* flows through valve 11*a* which is calibrated to a value for retaining and braking the movement of the frames. Part of the oil returns to the reservoir by flowing through the exchange block 10*a* and the remaining part returns to pump 7*a*; this latter draws in through its replenishing check valves the volume which it lacks.

For moving the frames backwards, it is sufficient to reverse the direction of operation of pump 7*a*. The oil is then forced into jack 4*a* and frame 1*a* moves back while pushing back the frame 1*b*. The oil from jack 4*b* flows through valve 11*b*, which like valve 11*a*, is calibrated so as to brake the return movements of the frames.

Both during the advance of the frames and during the retreat thereof, oil flows from one of the jacks 4*a* and 4*b* to the other, through pipe 16, but this circuit is at very low pressure.

It goes without saying that the present invention must not be considered as limited to the embodiment described and shown but covers on the contrary, all variants thereof, one of which consists of using only a single pump for driving the "motor" jack and to brake in a closed circuit on the second jack, after isolating its corresponding pump.

I claim:

1. A walking beam oven, comprising:

at least two successive assemblies formed by respective walking beams and actuatable independently of one another to advance articles through an oven;

a respective hydraulic jack connected to each of said assemblies for horizontally displacing each assembly;

a respective hydraulic pump connected to each of said jacks in a respective circuit having two sides;

a respective nonreturn valve provided on one of said sides of each of said circuits between each jack and the respective pump;

a pair of distributors provided in the other side of one of said circuits between one of said jacks and the respective pump;

a respective distributor provided in each of said sides of the other circuit between another of said jacks and the respective pump;

hydraulic lines connecting said distributors of said circuits; and a retractable stop provided on one of the assemblies and selectively engageable with the other assembly, said distributors being controllable to define a first mode of operation wherein said circuits are disconnected from one another and each of said pumps drives the respective jack and said stop is retracted so that said assemblies operate independently to advance said articles, and a second mode of operation wherein said circuits are coupled through said distributors and said jacks are connected in series to only one of said pumps through said distributors and said nonreturn valves, so that with said stop engaged with said other assembly, said assemblies push one another and are thereby synchronized for joint advance of said articles.

* * * * *